US008297733B2

(12) United States Patent
Tsuji

(10) Patent No.: US 8,297,733 B2
(45) Date of Patent: Oct. 30, 2012

(54) INK JET RECORDING APPARATUS HAVING RECOVERY DEVICE

(75) Inventor: Kikunosuke Tsuji, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 307 days.

(21) Appl. No.: 12/693,926

(22) Filed: Jan. 26, 2010

(65) Prior Publication Data

US 2010/0259580 A1 Oct. 14, 2010

(30) Foreign Application Priority Data

Apr. 10, 2009 (JP) ..... 2009-095411
Dec. 10, 2009 (JP) ..... 2009-280056

(51) Int. Cl.
*B41J 2/165* (2006.01)

(52) U.S. Cl. ..... 347/32; 347/29; 347/33

(58) Field of Classification Search ..... 347/32
See application file for complete search history.

(56) References Cited

U.S. PATENT DOCUMENTS

2001/0038401 A1* 11/2001 Kawase et al. ..... 347/32
2003/0081053 A1* 5/2003 Barinaga et al. ..... 347/32
2005/0036022 A1* 2/2005 Okamoto et al. ..... 347/101
2006/0209120 A1* 9/2006 Takagi ..... 347/29
2006/0274108 A1 12/2006 Shimizu
2007/0103505 A1* 5/2007 Takagi ..... 347/33
2007/0200893 A1* 8/2007 Nakashima ..... 347/33
2010/0182371 A1* 7/2010 Tomoguchi ..... 347/32

FOREIGN PATENT DOCUMENTS

JP 2006-289648 10/2006

* cited by examiner

*Primary Examiner* — Shelby Fidler
(74) *Attorney, Agent, or Firm* — Frommer Lawrence & Haug LLP

(57) ABSTRACT

An ink jet recording apparatus may include a recording head that extends in a direction perpendicular to a recording-medium-conveying direction. In some embodiments, the recording head may eject ink to a recording medium. An embodiment may include a recovery device that performs recovery processing of the recording head, the recovery device having a cap portion that covers an ink ejection surface of the recording head, and a wiping portion that wipes the ink ejection surface. In some embodiments, the recovery device may move along the recording-medium-conveying direction. When the recovery device moves along the recording-medium-conveying direction, the wiping portion wipes the ink ejection surface while moving along the recording-medium-conveying direction.

21 Claims, 8 Drawing Sheets

INK JET RECORDING APPARATUS HAVING RECOVERY DEVICE

INCORPORATION BY REFERENCE

This application is based upon and claims the benefit of priority from the corresponding Japanese Patent application No. 2009-095411, filed Apr. 10, 2009, and Japanese Patent application No. 2009-280056, filed Dec. 10, 2009, the entire contents of which are incorporated herein by reference.

FIELD OF THE INVENTION

The present invention relates to an ink jet recording apparatus that performs recording by ejecting ink onto a recording medium such as a sheet in a recording apparatus such as a facsimile machine, a copier, and/or a printer.

BACKGROUND OF THE INVENTION

Recording apparatuses such as facsimile machines, copiers, and printers record an image on a recording medium such as paper, cloth, or an overhead projector sheet ("OHP" sheet). The methods by which these recording apparatuses perform image recording are an ink-jet method, a wire-dot method, a thermal method, and the like. Furthermore, these recording methods are either a serial-type method or a line-head-type method. In the serial-type method, a recording head performs recording while moving on a recording medium. In the line-head-type method, recording is performed by a recording head that is fixed to the main body of the apparatus.

For example, in a line-head-type ink jet recording apparatus, an image is formed on a recording medium such as a sheet by ejecting ink from ink ejection nozzles of a line head having a recording range equal to or greater than the width of the recording medium, while the recording medium is conveyed at a high speed by conveying means such as a conveying belt that is provided in the main body of the apparatus. In this way, printing can be performed at a high speed as compared to a serial-type ink jet recording head that reciprocates in the width direction of a recording medium.

In some of such ink-jet-type printers, the recording head is capped in order to prevent drying of ink in the ink ejection nozzles (openings provided in the ink ejection surface of the recording head), or clogging up of the nozzles. Moreover, before capping the recording head, sometimes recovery processing of the recording head is performed by ejecting ink and thereafter wiping off ink adhering to the ink ejection surface. Thus, ink jet recording apparatuses in which the ink ejection surface is wiped and a cap is mounted on the recording head are known.

For example, an ink jet recording apparatus that has an ink jet recording head (recording head), and a maintenance mechanism (recovery device) that has a cap (cap portion) and a wiping blade (wiping portion) and is housed below ink-supplying paths that supply ink to the nozzles is known. When image forming is not being performed, the maintenance mechanism comes into contact with or close to nozzle plates of the ink jet recording heads and performs maintenance. This type of ink jet recording apparatus can be downsized, and the wiping blade wipes the ink ejection surface of the recording head by moving in a direction perpendicular to the direction in which the recording medium is conveyed.

However, in the above-described ink jet recording apparatus, since the recovery device wipes the ink ejection surface of the recording head by moving in a direction perpendicular to the recording-medium-conveying direction (in the longitudinal direction of the recording head), the distance over which the wiping portion moves is long, and the time taken for the wiping is long.

SUMMARY OF THE INVENTION

An ink jet recording apparatus according to an embodiment may include a recording head that extends in a direction perpendicular to a recording-medium-conveying direction. In some embodiments, a recording head ejects ink onto a recording medium. An embodiment may include a recovery device capable of performing recovery processing of the recording head. The recovery device may include a cap portion that covers an ink ejection surface of the recording head, and a wiping portion that wipes the ink ejection surface. In some embodiments, the recovery device may move along the recording-medium-conveying direction. When the recovery device moves along the recording-medium-conveying direction, the wiping portion may wipe the ink ejection surface while moving along the recording-medium-conveying direction.

The above and other objects, features, and advantages of the present invention will be more apparent from the following detailed description of embodiments taken in conjunction with the accompanying drawings.

In this text, the terms "comprising", "comprise", "comprises" and other forms of "comprise" can have the meaning ascribed to these terms in U.S. Patent Law and can mean "including", "include", "includes" and other forms of "include".

Various features of novelty which characterize the invention are pointed out in particularity in the claims annexed to and forming a part of this disclosure. For a better understanding of the invention, its operating advantages and specific objects attained by its uses, reference is made to the accompanying descriptive matter in which illustrative embodiments of the invention are depicted in the accompanying drawings in which corresponding components are identified by the same reference numerals.

BRIEF DESCRIPTION OF THE DRAWINGS

The following detailed description, given by way of example, but not intended to limit the invention solely to the specific embodiments described, may best be understood in conjunction with the accompanying drawings, in which.

DETAILED DESCRIPTION OF THE EMBODIMENTS

Reference will now be made in detail to various embodiments of the invention, one or more examples of which are illustrated in the accompanying drawings. Each example is provided by way of explanation of the invention, and by no way limiting the present invention. In fact, it will be apparent to those skilled in the art that various modifications, combinations, additions, deletions and variations can be made in the present invention without departing from the scope or spirit of the present invention. For instance, features illustrated or described as part of one embodiment can be used in another embodiment to yield a still further embodiment. It is intended that the present invention covers such modifications, combinations, additions, deletions, applications and variations that come within the scope of the appended claims and their equivalents.

Figure 1:
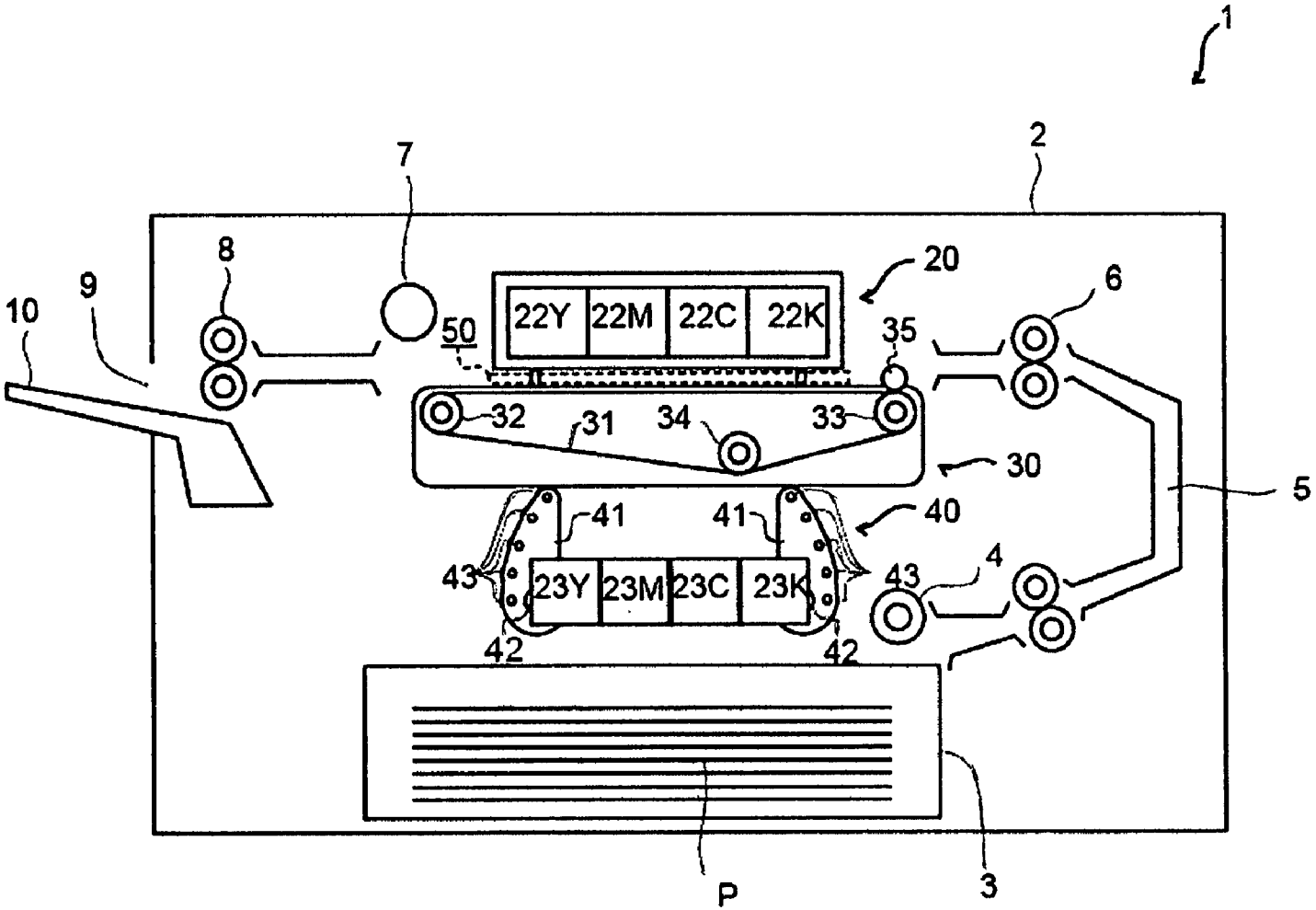
FIG. 1 is a vertical front sectional view illustrating the general structure of an ink jet printer, which is an example of an ink jet recording apparatus according to an embodiment of the present invention.

Embodiments of the present invention will be described below with reference to the drawings. FIG. 1 is a vertical front sectional view illustrating the general structure of ink jet printer 1, which is an example of an ink jet recording apparatus.

As shown in FIG. 1, sheet feed cassette 3, that stores sheets (recording media) P, may be disposed in the lower part of the interior of main body 2 of printer 1. The sheets P may be stored in sheet feed cassette 3 in a stacked state. In some embodiments, sheet feed device 4 may be disposed above the downstream portion of sheet feed cassette 3 in the sheet-conveying direction (recording-medium-conveying direction). As shown in FIG. 1, sheet feed device 4 may feed the sheets P toward the upper right of sheet feed cassette 3.

In some embodiments, sheet conveying path 5, registration roller pair 6, recording unit 20, and conveying unit 30 may be disposed downstream of sheet feed cassette 3 in the sheet-conveying direction. A sheet P fed from sheet feed cassette 3 may pass through sheet conveying path 5 and arrive at registration roller pair 6. In some embodiments, sheet conveying path 5 may include members associated with the process of conveying sheets from sheet feed cassette 3 to sheet discharge tray 10. For example, sheet conveying path 5 may be provided with pairs of conveying rollers that convey the sheet P, when necessary. In some embodiments, registration roller pair 6 may temporarily stop the sheet P and correct the orientation of the sheet P, and then again feed the sheet P. In various embodiments, recording unit 20 may be configured to perform ink-ejecting operation (ejects ink onto the sheet P), the timing of which is based on detection of the leading edge of the sheet P by a sheet-leading-edge-detecting member (not shown) that is provided in the portion of sheet conveying path 5 between recording unit 20 and registration roller pair 6.

As shown in FIG. 1, an embodiment may include conveying unit 30 having driving roller 32, driven roller 33, tension roller 34, and endless conveying belt 31 that is looped around these rollers. In some embodiments, conveying belt 31 may be rotated by driving roller 32 in a counterclockwise direction. Sheet P fed by registration roller pair 6 may be placed on the upper surface of conveying belt 31, and may be conveyed from the right side to the left side, as shown in FIG. 1.

In some embodiments, the conveying belt may be, but is not limited to a loop of one or more materials, for example, a belt having one end overlapping and bonded to the other end such that the belt is substantially continuous, a belt without a joint (e.g., a seamless belt), or the like. An embodiment may include roller 35 disposed in a position such that roller 35 abuts at least a portion of driven roller 33 with conveying belt 31 positioned therebetween. Thus, when sheet P is conveyed to conveying unit 30, sheet P may be pressed against conveying belt 31 from above.

Figure 2A:
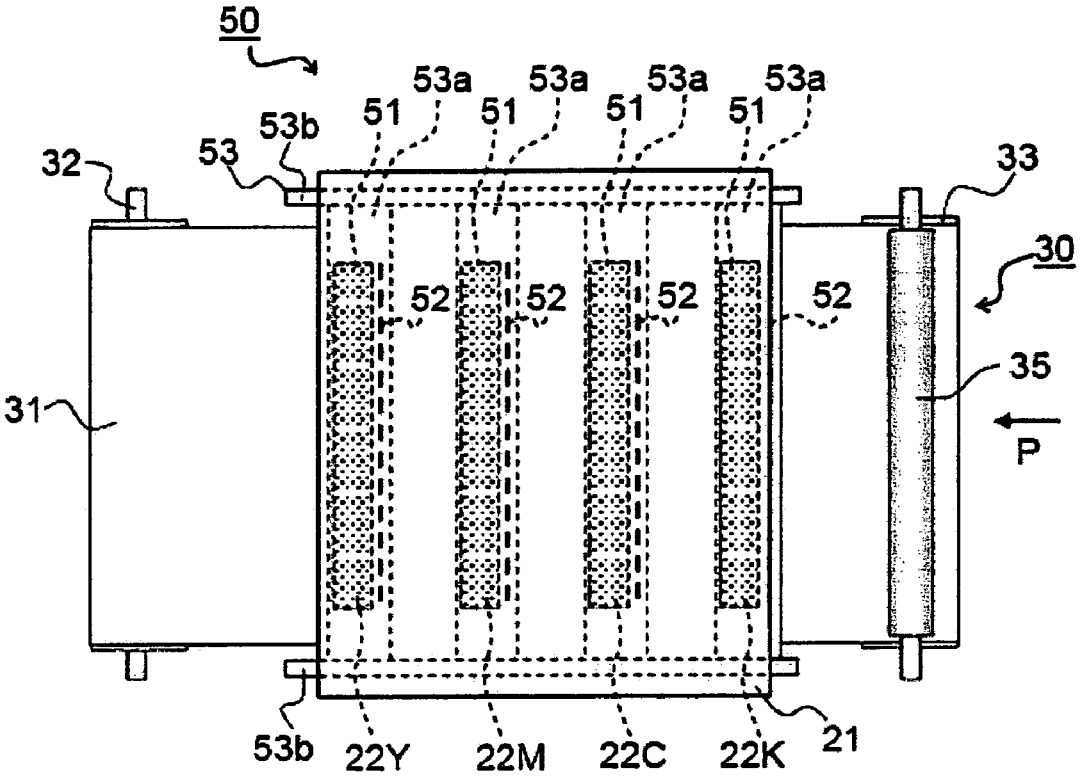
FIG. 2A is a schematic top plan view showing a portion around a recording unit and a conveying unit of the printer, in which caps are mounted on recording heads.
Figure 2B:
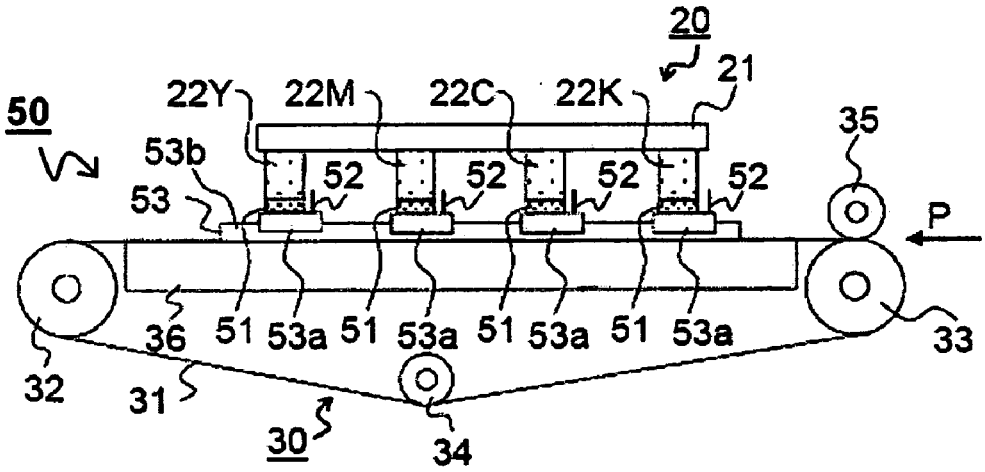
FIG. 2B is a schematic side sectional view of the portion shown in FIG. 2A.

As shown in FIG. 2B, some embodiments may include air suction unit 36 provided in a position in conveying unit 30 opposite recording unit 20. Various embodiments may include air suction unit 36 having a large number of openings on an upper surface for air suction (not shown). In some embodiments, conveying unit 30 may draw air from its upper surface in a downward direction utilizing air suction unit 36. A large number of openings for air suction (not shown) may be provided in conveying belt 31. In embodiments utilizing conveying belt 31 and air suction unit 36, conveying unit 30 may convey sheet P with sheet P adhering to the upper surface of conveying belt 31.

In some embodiments, printer 1 may receive image-data signals including characters, figures, patterns, and the like from an external computer (not shown). Image-data information may be sent to recording unit 20 that is disposed opposite and above conveying unit 30 as shown in FIG. 1. In various embodiments, recording unit 20 may be disposed such that a minute gap (for example, 1 mm) is provided between the bottom surface of recording heads 22 and the upper surface of conveying belt 31. Thus, some embodiments include a minute gap between the bottom surface of the recording heads and the sheet P being conveyed.

Various embodiments may include a recording unit having multiple recording heads. For example, a recording unit may include two, three, four or five recording heads. As shown in FIGS. 2A, 2B, 3A and 3*b*, embodiments may include recording unit 20 having four recording heads 22 corresponding to four colors. In some embodiments, each of recording heads 22 may extend in the sheet-width direction, which is perpendicular to the sheet-conveying direction (perpendicular to the direction in which the recording medium is conveyed). As shown in FIG. 1, the recording heads corresponding to the four colors may be arranged in the direction in which conveying belt 31 rotates, from the upstream side to the downstream side.

As depicted in FIG. 1, recording heads may correspond to particular colors. Colors utilized may include any colors. For example, recording head 22K may correspond to black, recording head 22C may correspond to cyan, recording head 22M may correspond to magenta, and recording head 22Y may correspond to yellow, arranged in this order from the upstream side in the direction in which conveying belt 31 rotates. In some embodiments, an arrangement of the recording heads may vary. In some embodiments, recording heads may be arranged in a staggered matrix arrangement. For example, some embodiments may include three recording heads arranged in a staggered matrix arrangement.

As shown in FIG. 1, four ink tanks 23 may be provided below conveying unit 30 and correspond to four recording heads 22 for the respective colors. Ink of the colors may be supplied from ink tanks 23 to recording heads 22 through supply tubes (not shown). In the description hereinafter, the identification symbols "K", "C", "M" and "Y" for recording heads 22 are omitted except when identification is necessary.

Various methods may be used as the ink ejection method of the recording heads including, but not limited to a piezoelectric method, a thermal ink jet method, and any other method in the art. For example, in the piezoelectric method, ink is forced out by using a piezoelectric element (not shown). In the thermal ink jet method, bubbles are generated in the ink by a heat-generating element, and the bubbles exert pressure on the ink to eject the ink.

In some embodiments, recording heads 22 of recording unit 20 eject ink onto sheet P placed on the surface of conveying belt 31 in accordance with image-data information received from the external computer. Embodiments may include recording heads supported on recording-head-supporting members. For example, as shown in FIGS. 2A-3B, recording heads 22 may be supported on recording-head-supporting member 21. In various embodiments, recording-head-supporting member 21 may be a substantially rectangular plate, and may be fixed to main body 2 of printer 1 together with recording heads 22. As conveying belt 31 rotates, ink of the respective colors may be ejected sequentially from recording heads 22 in accordance with predetermined timing that is based on the detection of the leading edge of sheet P by the above-mentioned sheet-leading-edge-detecting member. As a result, a color-ink image of superposed ink colors may be formed and printed on sheet P on the surface of the conveying belt. For example, a color-ink image of superposed four ink colors of black, cyan, magenta and yellow may be formed and printed on sheet P on the surface of conveying belt 31.

In some embodiments, drying device 7 may be disposed downstream of conveying unit 30 in the sheet-conveying direction. The ink ejected from the recording unit 20 onto sheet P is dried by the drying device 7.

In some embodiments, discharge roller pair 8, discharge opening 9, and discharge tray 10 may be provided downstream of drying device 7. As shown in FIG. 1, after the ink printed on sheet P is dried by drying device 7, sheet P may be fed leftward by discharge roller pair 8 and discharged through discharge opening 9 to discharge tray 10 (to the exterior of the apparatus). Various embodiments may include discharge tray 10 provided on the left-hand outer side of main body 2.

In some embodiments, purging of the recording heads may be performed to inhibit and/or prevent drying or clogging up of the recording heads. A purge may be performed in the following manner to prepare for the next printing action. When printing is started after recording unit 20 has been idle for a long period of time, ink in the nozzles that has become more viscous may be purged from all recording heads 22. In intervals between printing actions, such ink is purged from the nozzles of recording heads 22. An embodiment may include controlling an amount of ink-purged from the nozzles. For example, an amount of ink purged from the nozzles may be controlled to be less than or equal to 30 milliliters for 1 head (1 color). In some embodiments, an amount of ink purged from the nozzles may be controlled to be less than or equal to 10 milliliters for 1 head (1color). Some embodiments may include controlling an amount of ink to be less than or equal to 6 milliliter for 1 head (1 color). In some embodiments, after conveying unit 30 has been lowered, cap portion 51 may be brought close to recording heads 22 with a minute distance therebetween, and ink is purged into the cap portions 51.

As depicted in FIG. 1, some embodiments may include lifting device 40 for conveying unit 30 provided below conveying unit 30. In various embodiments, lifting device 40 may raise and/or lower conveying unit 30 in order to mount cap portions 51 (See FIGS. 2A to 3B) on recording heads 22. Some embodiments may include raising and/or lowering the conveying unit 30 to perform a purge, thereby inhibiting and/or preventing the drying of ink in the ink ejection nozzles (not shown) of recording heads 22 or clogging of the ink ejection nozzles of recording heads 22. Conveying unit 30 may be lowered or raised in order to handle jamming on conveying belt 31 in some embodiments. As shown in FIG. 1, lifting device 40 can lower conveying unit 30 (See FIG. 6) by rotating in a counterclockwise direction eccentric cams 41 that are on the upstream side in the conveying-belt-31-rotating direction (on the right side in FIG. 1), and rotating in a clockwise direction eccentric cams 41 that are on the downstream side in the conveying-belt-31-rotating direction (on the left side in FIG. 1).

In some embodiments, multiple eccentric cams may be provided. For example, eccentric cams 41 may be provided on the front side and the rear side of conveying unit 30 (four cams in total). An embodiment may allow the peripheral surfaces of eccentric cams 41 to abut the outer bottom surface of conveying unit 30 from below. As shown in FIG. 1, each of eccentric cams 41 has shaft portion 42 extending in the sheet-width direction and cam portion whose rotational axis is eccentric. In some embodiments, eccentric cam 41 may be rotated about the axis of shaft portion 42 by a motor (not shown). Various embodiments may include plurality of bearings 43, which are rotating members, provided in the peripheral edge of eccentric cam 41, partly protruding to the outside from the peripheral surface of the eccentric cam 41.

Each of bearings 43 may be rotatable about an axis parallel to the rotational axis of eccentric cams 41, in some embodiments. As shown in FIG. 1, bearings 43 may be arranged from the tip side to the rotational-axis side of eccentric cam 41 in sequence. In various embodiments, when printer 1 is printing, bearings 43 that are farthest from the shaft portions 42 of eccentric cams 41 abut the outer bottom surface of conveying unit 30 from below, and conveying unit 30 is at its highest position, as shown in FIG. 1.

From the state depicted in FIG. 1, when eccentric cams 41 on the upstream side in the sheet-conveying direction of conveying unit 30 are rotated in the counterclockwise direction as viewed from the front side, and eccentric cams 41 on the downstream side are rotated in the clockwise direction, conveying unit 30 is lowered as bearings 43 sequentially come into contact with the bottom surface of conveying unit 30, from those bearings 43 farthest from shaft portions 42 to those bearings 43 closest to shaft portions 42. When eccentric cams 41 are thus rotated, there are periods of time during which two adjacent bearings 43 simultaneously abut the bottom surface of conveying unit 30.

In some embodiments, conveying unit 30 may be lowered to allow removal of the cap portions 51 from recording heads 22. To bring conveying unit 30 back to the position in which printing is performed, eccentric cams 41 may be rotated in the directions reverse to the above-described directions and thereby conveying unit 30 is raised to the position shown in FIG. 1. Moreover, as described later, cap portions 51 can be mounted on recording heads 22 by raising conveying unit 30.

Next, the general configuration and operation of recovery device 50 will be described with reference to FIGS. 1 to 4B.

In some embodiments, recovery device 50 may include cap portions 51 and wiping portion 52. In some embodiments, cap portion may be a cap or any other geometry known in the art configured to cover the recording heads. Wiping portions may include, but are not limited to members having an edge capable of cleaning a surface of the recording heads (e.g., blades), materials capable of cleaning a surface of the recording heads (e.g., flexible plastic and/or rubber capable of wiping the surface of the recording heads) or any other configuration known in the art. In embodiments utilizing recovery device 50, cap portions 51 may be mounted on or removed from recording heads 22, and the ink ejection surfaces of recording heads 22 may be wiped, thereby performing recovery processing of recording heads 22.

Figure 3A:
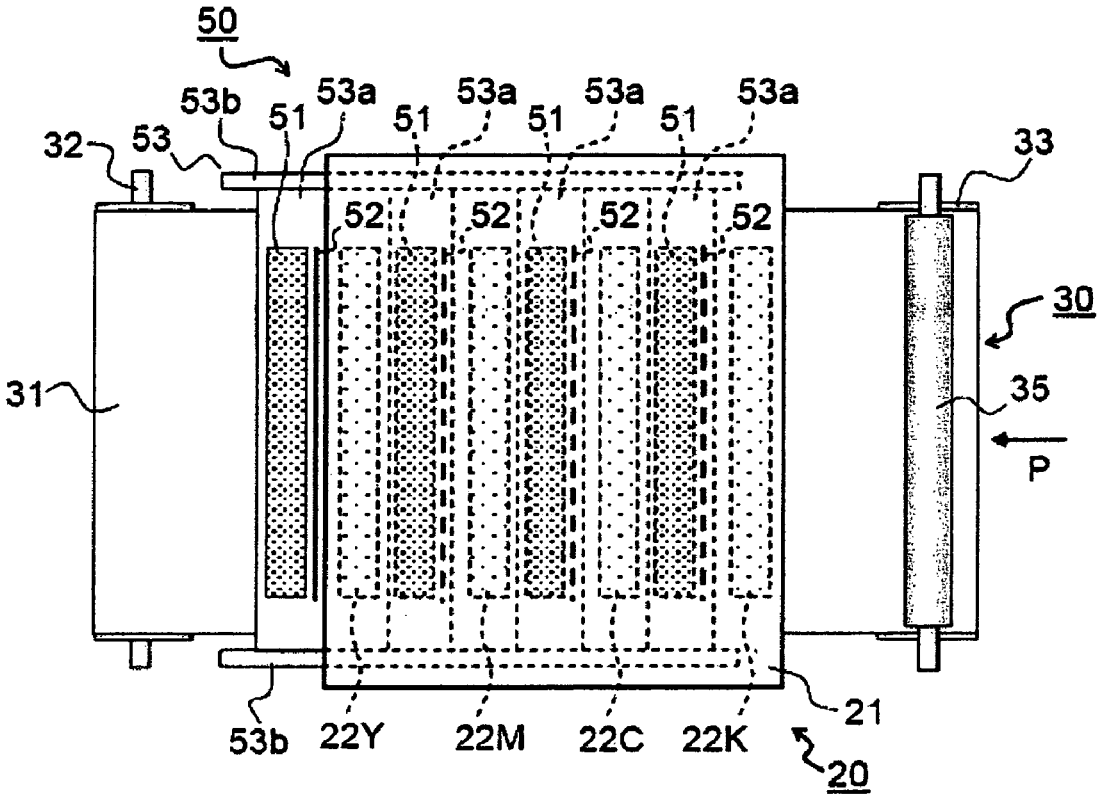
FIG. 3A is a schematic top plan view showing a portion around the recording unit and the conveying unit of the printer, in which the recording heads can perform printing.
Figure 3B:
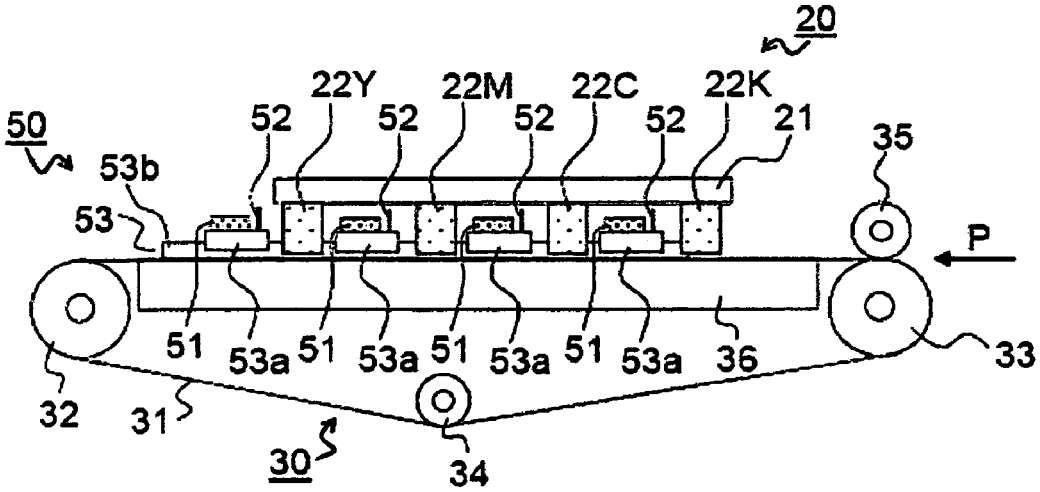
FIG. 3B is a schematic side sectional view of the portion shown in FIG. 3A.
Figure 4A:
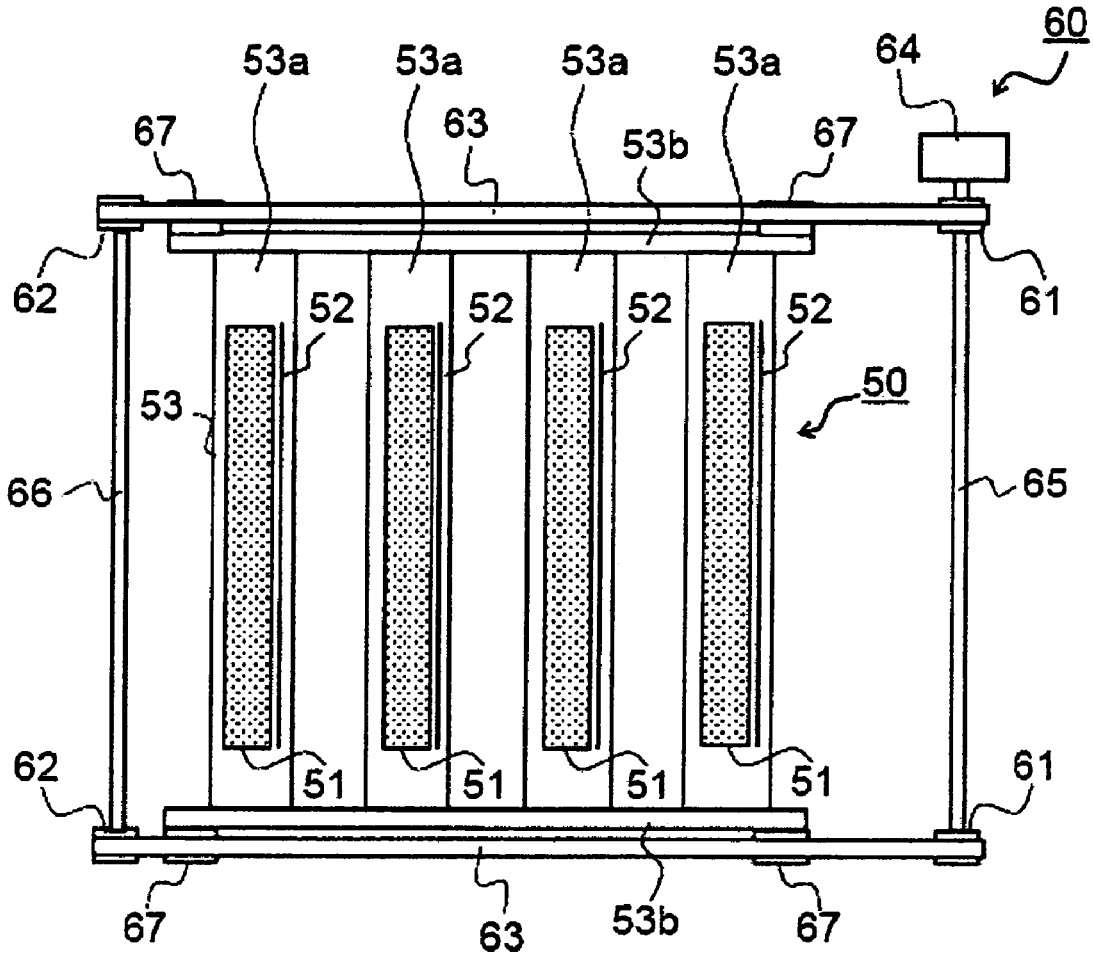
FIG. 4A is a schematic top plan view illustrating a cap unit and a horizontal-direction driving device.
Figure 4B:
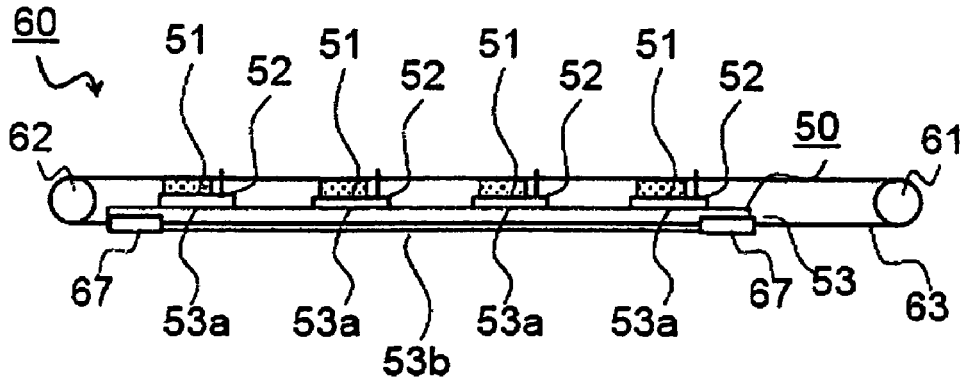
FIG. 4B is a schematic side view of the portion shown in FIG. 4A.

FIG. 2A depicts schematic top plan view showing a portion around the recording unit and the conveying unit of the printer, with the cap portions mounted on the recording heads. FIG. 2B is a schematic side sectional view of the portion shown in FIG. 2A. FIG. 3A is a schematic top plan view showing a portion around the recording unit and the conveying unit of the printer, in which the recording heads can perform printing. FIG. 3B depicts a schematic side sectional view of the portion shown in FIG. 3A. FIG. 4A is a schematic top plan view showing the cap unit and a horizontal-direction driving device. FIG. 4B is a schematic side view of the portion shown in FIG. 4A. The same parts as those illustrated in FIG. 1 are denoted by the same reference numerals and description thereof is omitted.

As shown in FIGS. 2B and 3B, some embodiments may include recovery device 50 provided below recording unit 20. In some embodiments, recovery device 50 may include cap portions 51, wiping portions 52, and cap base 53. As shown in FIGS. 4A-4B, recovery device 50 may be moved in a horizontal direction by driving device 60. In some embodiments, recovery device 50 may be supported above conveying unit 30 by conveying unit 30. Thus, recovery device 50 can be raised and lowered together with conveying unit 30 by lifting device 40. In some embodiments, a predetermined gap may be provided between the bottom surface of cap base 53 and the top surface (the sheet-conveying surface) of conveying unit 30, so that sheet P can pass therethrough.

In some embodiments, cap portions 51 may be made of an elastic material. As shown in FIG. 2B, cap portions 51 may be disposed on supporting members 53*a* of cap base 53, so that cap portions 51 correspond to recording heads 22 for the respective colors, that are disposed in the sheet-width direction. In some embodiments, a size of a cap portion may correspond to the size of an ink ejection surface. For example, the size of each of cap portions 51 is such that cap portion 51 can cover an ink ejection surface provided in the bottom surface of the corresponding recording head 22 to inhibit and/or prevent the ink ejection surface from being exposed to the air. An embodiment may include cap portion 51 which is a member in the form of a box, having an open portion on its upper side and having a downwardly concave portion.

In some embodiments, cap portions 51 may be mounted on the bottom surface of recording heads 22 from below. Ink discharge ports (not shown) may be provided in the bottom surfaces of cap portions 51, so that the ink purged from recording heads 22 at the time of purge can be discharged to the exterior of cap portions 51.

In some embodiments, wiping portions 52 may be made of an elastic material. As shown in FIGS. 2A-2B, some embodiments may include wiping portions 52 disposed on supporting members 53*a*. Wiping portions 52 may be disposed on the upstream side of cap portion 51 in the sheet-conveying direction (on the right side in FIGS. 2A to 3B), close to and extending along cap portion 51. As depicted in FIGS. 2B, 3B, 4B, some embodiments may include wiping portions 52 which are higher than the cap portions 51 with supporting members 53*a* as the reference surfaces. As described later, wiping portions 52 may wipe the ink ejection surfaces of recording heads 22 when recovery device 50 moves in the sheet-conveying direction.

As shown in FIGS. 4A and 4B, cap base 53 may include supporting members 53*a* and connecting members 53*b*. Supporting members 53*a* may extend in the longitudinal direction of cap portions 51 (the sheet-width direction) and support cap portions 51. Connecting members 53*b* may extend in the sheet-conveying direction with supporting members 53*a* therebetween, and connect the supporting members 53*a* at the opposite longitudinal ends of supporting members 53*a*. Thus, cap portions 51 and wiping portions 52 can be moved as an integral body.

As shown in FIG. 4A, driving device 60, which moves recovery device 50 horizontally in the sheet-conveying direction, has a pair of driving pulleys 61, a pair of driven pulleys 62, a pair of driving belts 63, and driving motor 64. In some embodiments, the driving pulleys 61 may be positioned so that the cap base 53 is positioned between multiple driving pulleys 61. Driving pulleys 61 may be positioned on an upstream side of the cap base 53 in some embodiments. For example, as shown in FIG. 4A driving pulleys 61 may be positioned so that cap base 53 is positioned between multiple driving pulleys 61 and on the downstream side of driving pulleys 61 in the sheet-conveying direction. As depicted in FIG. 4A, driven pulleys 62 are disposed on the downstream side in the sheet-conveying direction. Thus, driven pulleys 62 may be positioned downstream of cap base 53 in the sheet-conveying direction as shown in FIG. 4A. In some embodiments, driving belts 63 may be looped around driving pulleys 61 and driven pulleys 62, and extend in the sheet-conveying direction. As is shown in FIG. 4*a*, driving motor 64 rotationally drives driving pulleys 61.

As depicted in FIG. 4A, two driving pulleys 61 may be supported on driving shaft 65 that extends in the sheet-width direction and is coupled to driving motor 64. Two driven pulleys 62 may be supported on driven shaft 66 that extends in the sheet-width direction. Driving motor 64 can rotate in either direction. In some embodiments, connecting members 53*b* of cap base 53 may be fixed to driving belts 63 through fixing members 67 at their opposite ends in the sheet-conveying direction. Therefore, in some embodiments, recovery device 50 may be fixed to driving device 60.

In various embodiments, driving shaft 65 and driven shaft 66 are rotatably supported on outer frames (not shown) provided on conveying unit 30. An embodiment may include providing the outer frames at opposite sides of the conveying unit 30 in the sheet-width direction. Driving shaft 65 and driven shaft 66 may be rotatably supported on the outer frames of conveying unit 30, in suitable positions higher than the surface of conveying unit 30 that faces the ink ejection surfaces of recording heads 22. That is, driving device 60 is supported on the conveying unit 30. Since recovery device 50 is supported by the driving device 60, recovery device 50 is also supported by conveying unit 30.

When driving motor 64 rotates in a clockwise direction as shown in FIG. 4B, driving belts 63 rotate in a clockwise direction and thereby cap base 53 and recovery device 50 move horizontally toward the downstream side in the sheet-conveying direction (toward the left side in FIG. 4B). On the other hand, when driving motor 64 rotates in a counterclockwise direction as shown in FIG. 4B, driving belts 63 rotate in a counterclockwise direction and thereby cap base 53 and recovery device 50 move horizontally toward the upstream side in the sheet-conveying direction (toward the right side in FIG. 4B).

In an embodiment, to mount cap portions 51 on recording heads 22, recovery device 50 is moved horizontally to a mounting position, in which the cap portions 51 are positioned below recording heads 22 and can be removably mounted on the recording heads 22 (see FIGS. 2A, 2B, 5 and 6). To perform printing by ejecting ink from the recording heads 22 onto sheet P, recovery device 50 is moved horizontally to a withdrawn position, in which cap portions 51 and wiping portions 52 do not inhibit the ejection of ink from recording heads 22 onto sheet P (see FIGS. 3A, 3B, 7 and 8). In this embodiment, the mounting position and the withdrawn position refer to positions in the sheet-conveying direction.

In this example, the withdrawn positions are such that each of cap portions 51 is positioned between its corresponding recording head 22 and the next recording head 22 on the downstream side in the sheet-conveying direction. That is, when in the withdrawn position, cap portion 51 corresponding to recording head 22K is positioned between recording head 22K and recording head 22C; cap portion 51 corresponding to recording head 22C is positioned between recording head 22C and recording head 22M; and cap portion 51 corresponding to recording head 22M is positioned between recording head 22M and recording head 22Y (See FIGS. 3A and 3B).

As shown in FIGS. 3A-3B, cap portion 51 corresponding to recording head 22Y, which is the most downstream in the sheet-conveying direction, is positioned on the downstream side of recording head 22Y when recovery device 50 has been moved to the withdrawn position. Thus, since the withdrawn position of the recovery device 50 is such that cap portions 51 are positioned between recording heads 22, the distance between the withdrawn position and the mounting position may be short so that the time taken for the operation of capping may be short. In various embodiments, the operation of capping may be performed in range of time from about 2 seconds to about 12 seconds. Some embodiments may include capping the recording heads in a time frame ranging from about 3 second to about 9 seconds. Further, capping the recording heads may occur in a time frame ranging from about 4 seconds to about 7 seconds. For example, in an embodiment it may take about 5 second for the operation of capping to be performed.

Figure 6:
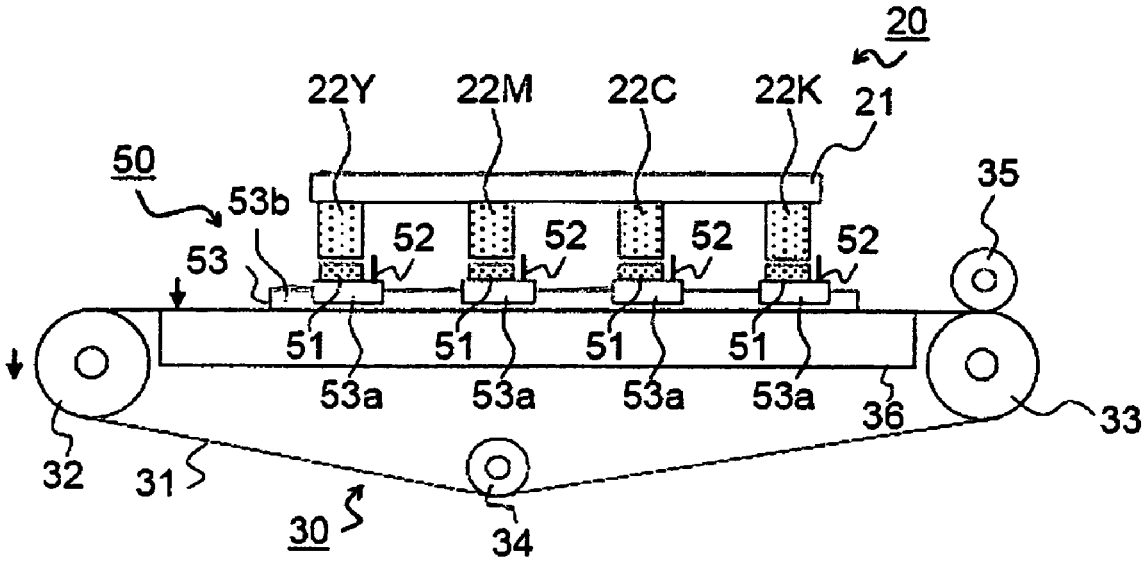
FIG. 6 is a schematic side sectional view illustrating the operation of the cap unit, and shows the portion around the recording unit and the cap unit when the cap unit has moved downward from the state in which the caps are mounted on the recording heads.

To perform the purge, as shown in FIG. 6 recovery device 50 in the withdrawn position is lowered by lifting device 40 (See FIG. 1) and moved to the mounting position by driving device 60 (See FIG. 4A), or recovery device 50 in the mounting position is lowered by lifting device 40, so that the purge can be performed. To perform the recovery processing of recording heads 22, recovery device 50 that has been lowered by lifting device 40 is moved between the mounting position (See FIG. 6) and the withdrawn position (See FIG. 7) by driving device 60. As a result, each of wiping portions 52 can wipe the ink ejection surface of the corresponding recording head 22 while moving in the sheet-conveying direction.

Figure 5:
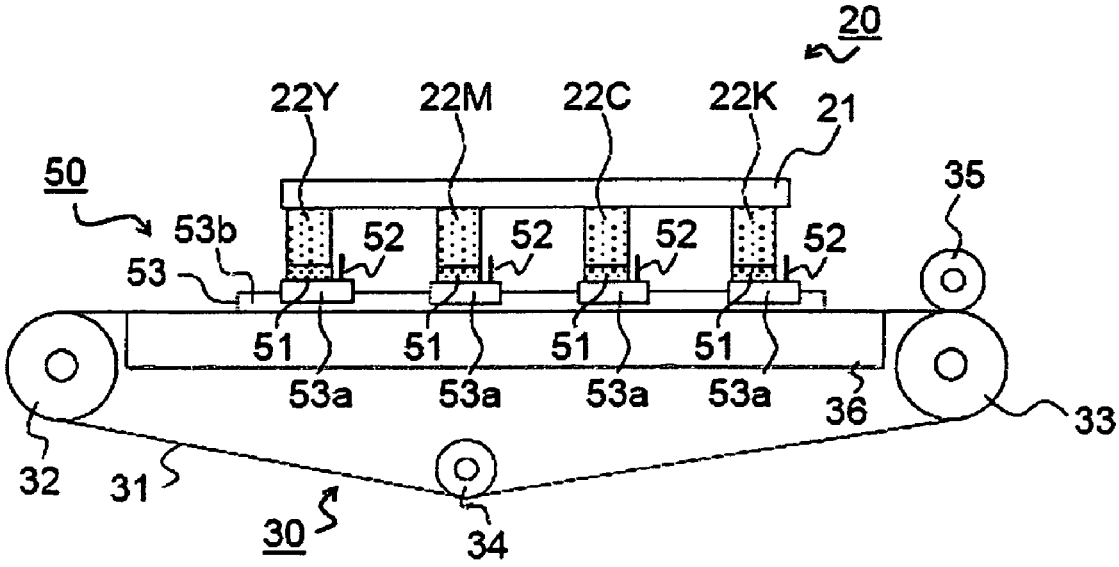
FIG. 5 is a schematic side sectional view illustrating the operation of the cap unit, and shows a portion around the recording unit and the cap unit when the caps are mounted on the recording heads.
Figure 7:
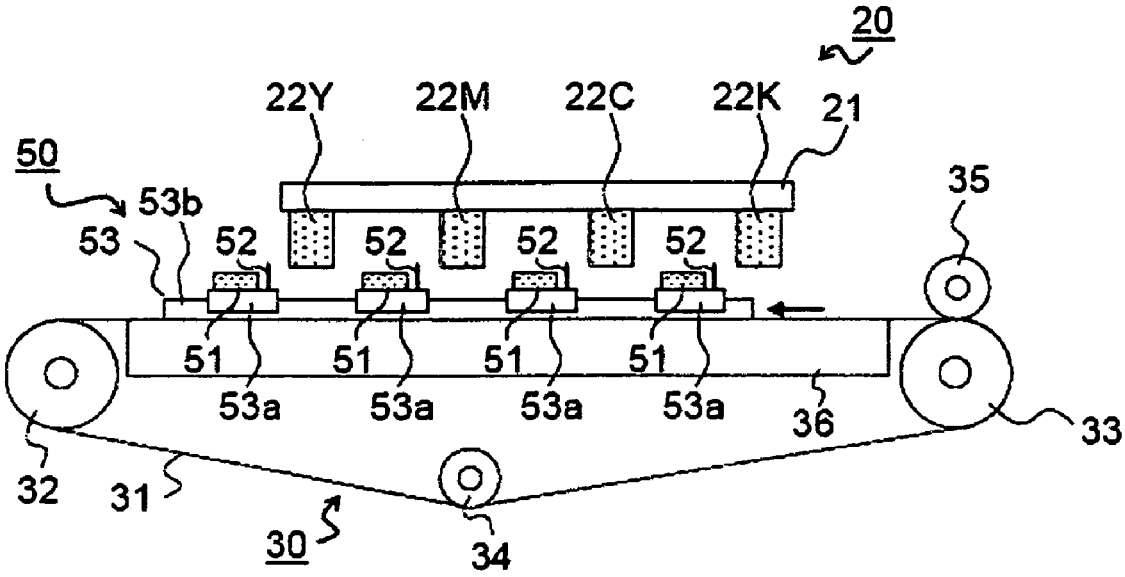
FIG. 7 is a schematic side sectional view illustrating the operation of the cap unit, and shows the portion around the recording unit and the cap unit when the cap unit has moved from the position shown in FIG. 6 to a withdrawn position.
Figure 8:
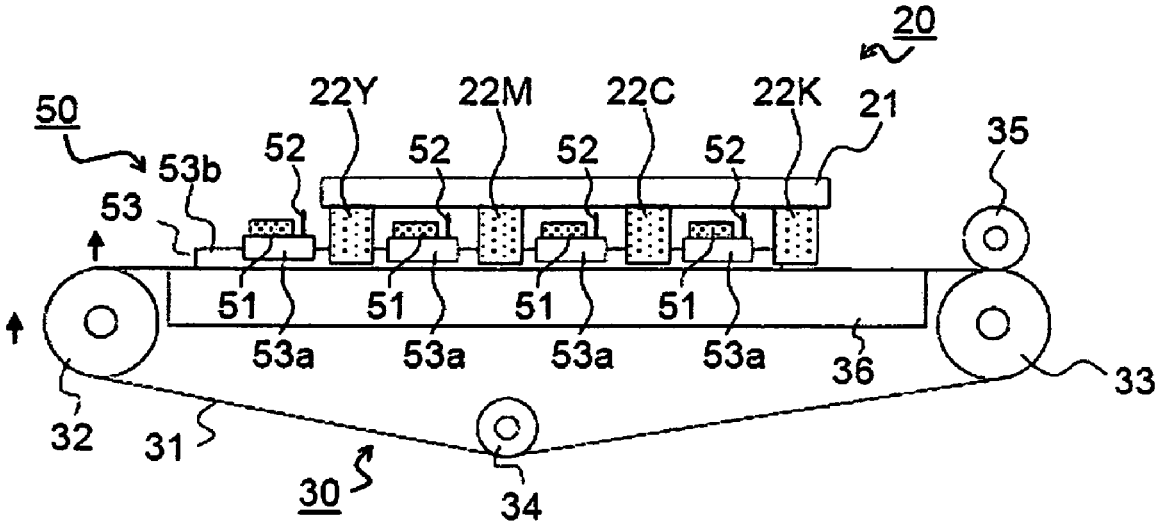
FIG. 8 is a schematic side sectional view illustrating the operation of the cap unit, and shows the portion around the recording unit and the cap unit, in which the recording heads can perform printing.

Next, the movement of the recovery device 50 will be described. FIGS. 5 to 8 are schematic side sectional views showing a portion around the recording unit and the recovery device, and illustrate the movement of the recovery device. In FIG. 5, the cap portions are in the mounting position and mounted on the recording heads. In FIG. 6, the recovery device is in the mounting position and has been moved downward. In FIG. 7, the recovery device has been moved from the mounting position to the withdrawn position. In FIG. 8, the recording heads can perform printing. The same parts as those in FIGS. 1 to 4B are denoted by the same reference numerals and description thereof is omitted.

In FIG. 5, the cap portions 51 are mounted on recording heads 22 in the mounting position. From this state, as shown in FIG. 6, recovery device 50 is lowered together with conveying unit 30 by lifting device 40 (See FIG. 1). Thus, cap portions 51 are moved downward from recording heads 22, and the purge is performed. In this position, each of wiping portions 52 is located on the upstream side of the corresponding recording head 22 in the sheet-conveying direction, and the tips of wiping portions 52 are somewhat higher than the bottom surfaces (ink ejection surface) of recording heads 22.

In some embodiments, after the purge is performed, recovery device 50 is moved by driving device 60 (see FIGS. 4A and 4B) toward the downstream side in the sheet-conveying direction (the direction shown by an arrow in FIG. 7), from the mounting position shown in FIG. 6 to the withdrawn position shown in FIG. 7. At this time, as recovery device 50 moves, wiping portions 52 wipe the ink ejection surfaces of recording heads 22 while moving toward the downstream side in the sheet-conveying direction. Since the tips of wiping portions 52 are somewhat higher than the ink ejection surfaces of recording heads 22 as mentioned above, wiping portions 52 may contact the ink ejection surfaces in a bowed state.

Then, recovery device 50 in the withdrawn position is raised together with conveying unit 30 by lifting device 40 (see FIG. 1) as shown in FIG. 8. Thus, recording heads 22 face the sheet-conveying surface (the top surface of conveying unit 30) with a predetermined gap therebetween, so that printing can be performed by ejecting ink onto sheet P that is conveyed (see FIG. 1).

After the printing is ended, recovery device 50 in the withdrawn position shown in FIG. 8 is lowered together with conveying unit 30 by lifting device 40 (See FIG. 1) to the configuration depicted in FIG. 7. Then, while recovery device 50 is moved from the withdrawn position to the mounting position, which is on the upstream side in the sheet-conveying direction (See FIG. 6), wiping portions 52 wipe the ink ejection surfaces of the respective recording heads 22 while moving from the downstream side to the upstream side of the sheet-conveying direction. Then, recovery device 50 in the mounting position shown in FIG. 6 is raised together with conveying unit 30 by lifting device 40, whereupon the cap portions 51 are mounted on recording heads 22 as is depicted in FIG. 5.

As described above, recovery device 50 moves along the sheet-conveying direction and thereby wiping portions 52 move along the sheet-conveying direction while wiping the ink ejection surfaces of recording heads 22. As a result, the distance over which wiping portions 52 move for wiping become shorter and therefore the time taken for the wiping may be reduced. Moreover, wiping portions 52 wipe recording heads 22 along the sheet-conveying direction. This may inhibit and/or suppress the generation of force that acts on the ink ejected from recording heads 22 in a direction perpendicular to the sheet-conveying direction (for example, tilting of the ink-ejecting direction of recording heads 22 relative to the sheet-conveying direction after the wiping). As a result, occurrence of undesired vertical lines in the image due to inaccurate landing of ink can be reduced and/or inhibited. Therefore, degradation of image quality due to the wiping of recording heads 22 can be reduced and/or prevented.

In some embodiments, driving device 60 moves recovery device 50 along the sheet-conveying direction between the mounting position and the withdrawn position. As driving device 60 moves recovery device 50 along the sheet-conveying direction, wiping portions 52 wipe the ink ejection surfaces of recording heads 22. Therefore, a separate driving source dedicated to the wiping action is unnecessary. This may reduce the number of components or the complexity of the configuration. In some embodiments, a separate driving source for the wiping action by wiping portions 52 may be provided.

In various embodiments, wiping portions 52 wipe the ink ejection surfaces of recording heads 22 by the movement of recovery device 50 between the mounting position and the withdrawn position. Therefore, by moving recovery device 50 in order to mount or remove the cap portions 51 or to perform printing, the ink ejection surfaces of the recording heads 22 are simultaneously wiped. As a result, the distance over which the recovery device 50 moves can be made shorter.

In an embodiment, a plurality of recording heads 22 are provided and the withdrawn positions of cap portions 51 are such that cap portions 51 are positioned between recording heads 22. As a result, the distance between the mounting position and the withdrawn position of each cap portion 51 can be made short and the time taken for the operation can be reduced. In some embodiments, the withdrawn positions of cap portions 51 may vary. For example, the withdrawn positions of cap portions may be on the upstream side or the downstream side of recording-head-supporting member 21 in the sheet-conveying direction.

The present invention is not limited to the above-described embodiment, and various other changes are possible within the scope of the present invention. For example, a number of nozzles in recording head 22, the distance between the nozzles, and the like may be appropriately set. Moreover, the number of recording heads 22 may vary, and may be one, for example.

Having thus described in detail embodiments of the present invention, it is to be understood that the invention defined by the foregoing paragraphs is not to be limited to particular details and/or embodiments set forth in the above description, as many apparent variations thereof are possible without departing from the spirit or scope of the present invention.

What is claimed is:

1. An ink jet recording apparatus comprising:

a recording head that extends in a direction perpendicular to a recording-medium-conveying direction, and configured to eject ink onto a recording medium;

a recovery device configured to perform recovery processing of the recording head, the recovery device having a cap portion that is configured to cover at least a portion of an ink ejection surface of the recording head, and a wiping portion configured to wipe at least a portion of the ink ejection surface;

a driving device configured to move the recovery device along the recording-medium-conveying direction between a mounting position in which the cap portion can be mounted on or removed from the recording head, and a withdrawn position in which the cap portion withdraws when the recording head performs printing on the recording medium, the driving device comprising a driving shaft and a driven shaft; and a conveying unit configured to convey the recording medium, the conveying unit comprising a driving roller and a driven roller, wherein the driving shaft and the driven shaft are disposed closer to the recording head than the driving roller and the driven roller;

wherein the recording head is operable to form an image on the recording medium that is conveyed by the conveying unit, and the driving device is supported by the conveying unit; and wherein the recovery device moves along the recording-medium-conveying direction, and when the recovery device moves along the recording-medium-conveying direction, the wiping portion wipes the ink ejection surface while moving along the recording-medium-conveying direction.

2. The ink jet recording apparatus according to claim 1, wherein when the recovery device is moved between the mounting position and the withdrawn position by the driving device, the wiping portion wipes the ink ejection surface.

3. The ink jet recording apparatus according to claim 1, wherein a plurality of the recording heads is provided, and the withdrawn position is such that the cap portion is positioned between the recording heads.

4. The ink jet recording apparatus according to claim 1, further comprising:

a lifting device, wherein the recovery device is supported above the conveying unit by the conveying unit;

wherein the conveying unit is configured to be raised and lowered by the lifting device relative to the recording head; and wherein the recovery device is configured such that when the conveying unit is raised and lowered by the lifting device relative to the recording head, the recovery device is raised and lowered by the lifting device relative to the recording head.

5. The ink jet recording apparatus according to claim 1, wherein the recovery device has a cap base, and the cap portion and the wiping portion are disposed on the cap base.

6. The ink jet recording apparatus according to claim 5, wherein the wiping portion is higher than the cap portion with the cap base as the reference surface.

7. The ink jet recording apparatus according to claim 1, wherein the recovery device has a cap base and a fixing member, and wherein the cap portion and the wiping portion are disposed on the cap base, and the cap base is supported by the driving device through the fixing member.

8. The ink jet recording apparatus according to claim 7, wherein the wiping portion is higher than the cap portion with the cap base as the reference surface.

9. The ink jet recording apparatus according to claim 7, wherein the recovery device is supported above the conveying unit by the conveying unit; and wherein a predetermined gap is provided between a bottom surface of the cap base and a top surface of the conveying unit.

10. The ink jet recording apparatus according to claim 1, wherein the driving device further comprises:

a pair of driving pulleys supported on the driving shaft, a pair of driven pulleys supported on the driven shaft, and a pair of driving belts looped around the driving pulleys and the driven pulleys.

11. The ink jet recording apparatus according to claim 10, wherein the recovery device has a cap base and a fixing member, the cap portion and the wiping portion are disposed on the cap base, and the cap base is fixed to the driving belts through the fixing member.

12. The ink jet recording apparatus according to claim 11, wherein the cap base is fixed to an inner surface of the driving belts through the fixing member.

13. The ink jet recording apparatus according to claim 10, wherein the driving device further comprises a driving motor;

wherein the driving motor is configured to rotate in a forward and a reverse direction and to rotationally drive the driving pulleys in the forward and the reverse direction;

wherein the recovery device and the wiping portion are each configured such that when the driving pulleys are rotated in one direction of the forward and the reverse direction by the driving motor, (i) the recovery device moves from the mounting position to the withdrawn position and (ii) the wiping portion wipes the ink ejection surface; and wherein the recovery device is configured such that when the driving pulleys are rotated in another direction of the forward and the reverse direction by the driving motor, the recovery device moves from the withdrawn position to the mounting position.

14. An ink jet recording apparatus comprising:

a recording head configured to eject ink onto a recording medium; and a recovery device configured to perform recovery processing of the recording head and comprising:

a cap portion configured to cover at least a portion of an ink ejection surface of the recording head; and a wiping portion mechanically coupled to the cap portion and configured to clean at least a portion of the ink ejection surface;

a driving device configured to move the recovery device between a mounting position in which the cap portion can be mounted on or removed from the recording head, and a withdrawn position in which the cap portion withdraws when the recording head performs printing on the recording medium, the driving device comprising a driving shaft and a driven shaft; and a conveying unit configured to convey the recording medium, the conveying unit comprising a driving roller and a driven roller, wherein the driving shaft and the driven shaft are disposed closer to the recording head than the driving roller and the driven roller; and wherein the recovery device is supported above the conveying unit by the conveying unit.

15. The ink jet recording apparatus according to claim 14, wherein when the recovery device is moved between the mounting position and the withdrawn position by the driving device, the wiping portion wipes the ink ejection surface.

16. The ink jet recording apparatus according to claim 14, wherein the wiping portion and the cap portion are in a fixed spatial relationship.

17. The ink jet recording apparatus according to claim 14, wherein the wiping portion and the cap portion are configured to be driven by a common said driving device.

18. The ink jet recording apparatus according to claim 14, wherein the recording head comprises a plurality of the recording heads, and the withdrawn position is such that the cap portion is positioned between the recording heads.

19. The ink jet recording apparatus according to claim 14, wherein the recording head is configured to form an image on the recording medium that is conveyed by the conveying unit, and the driving device is supported by the conveying unit.

20. The ink jet recording apparatus according to claim 19, further comprising:

a lifting device, wherein the recovery device is supported above the conveying unit by the conveying unit;

wherein the conveying unit is configured to be raised and lowered by the lifting device relative to the recording head; and wherein the recovery device is configured such that when the conveying unit is raised and lowered by the lifting device relative to the recording head, the recovery device is raised and lowered by the lifting device relative to the recording head.

21. An ink jet recording apparatus comprising:

a recording head configured to eject ink onto a recording medium; and a recovery device configured to perform recovery processing of the recording head and comprising:

a cap portion configured to cover at least a portion of an ink ejection surface of the recording head; and a wiping portion mechanically coupled to the cap portion and configured to clean at least a portion of the ink ejection surface;

a driving device configured to move the recovery device between a mounting position in which the cap portion can be mounted on or removed from the recording head, and a withdrawn position in which the cap portion withdraws when the recording head performs printing on the recording medium, the driving device comprising a driving shaft and a driven shaft; and a conveying unit configured to convey the recording medium, the conveying unit comprising a driving roller and a driven roller, wherein the driving shaft and the driven shaft are disposed closer to the recording head than the driving roller and the driven roller;

wherein the conveying unit is configured to be raised and lowered by the lifting device relative to the recording head; and wherein the recovery device is configured such that when the conveying unit is raised and lowered by the lifting device relative to the recording head, the recovery device is raised and lowered by the lifting device relative to the recording head.

* * * * *